United States Patent [19]

Patterson

[11] Patent Number: 4,833,960

[45] Date of Patent: May 30, 1989

[54] LUMBER CONVEYOR ASSEMBLY FOR BAND SAW

[76] Inventor: Raymond E. Patterson, Rte. 2, Box 416-B, Pontotoc, Miss. 38863

[21] Appl. No.: 203,095

[22] Filed: Jun. 7, 1988

[51] Int. Cl.[4] ..... B27B 25/02

[52] U.S. Cl. ..... 83/420; 83/435; 83/436; 83/424; 198/790

[58] Field of Search ..... 83/436, 415, 418, 420, 83/435, 422, 871, 920, 424, 425; 144/13; 198/785, 790

[56] References Cited

U.S. PATENT DOCUMENTS

| | | | |
|---|---|---|---|
| 3,314,455 | 4/1967 | Taylor | 83/422 X |
| 3,554,250 | 1/1971 | Ulsky | 83/418 X |
| 4,452,118 | 6/1984 | Muller | 83/420 X |

*Primary Examiner*—Donald R. Schran

*Attorney, Agent, or Firm*—Watson, Cole, Grindle & Watson

[57] ABSTRACT

A conveyor assembly which can be mounted on a band saw table to convey lumber to be cut to and away from the saw blade includes two guide/drive subassemblies which are independently positionable on the band saw table on opposite sides of the saw blade, each guide/-drive subassembly including two spaced apart gripping roller for contacting an adjacent side of the lumber. The two gripping rollers of one of the guide/drive subassemblies are spring biased towards the gripping rollers of the other guide/drive subassembly to accommodate lumber of differing widths. The two guide/drive subassemblies include respective drive systems to positively rotate the gripping rollers thereof in the same direction and at the same speed, and a transmission chain extends between the two guide/drive subassemblies to connect the two drive systems in such a way that the gripping rollers of one guide/drive subassembly rotate in the opposite direction to the gripping rollers of the other guide/drive subassembly.

9 Claims, 3 Drawing Sheets

100
101
101b
104
104b
116
117
118
108
115
106
109
110
111
113
105
114
103
B
112
157
158
140
154
150b
156
150a
147
300
102
104a
138
137
134
130b
135
136
120
130a
125
101a
3
5
201
200
T
204
205
204b
B'
203
242
206,207
230
208
234
R
251
209
240
241
S
202
E
204a
250
224
220
240
201a
2

LUMBER CONVEYOR ASSEMBLY FOR BAND SAW

BACKGROUND OF THE INVENTION

The present invention relates to conveyor assemblies for transporting lumber, and in particular to conveyor assemblies which are used for transporting lumber to and past a saw blade of a band saw.

Conveyor mechanisms for conveying lumber to and past a saw blade of a band saw are known. Some have a relatively simple construction (see U.S. Pat. No. 4,662,413) and some are rather complicated (see U.S. Pat. No. 3,827,324). Neither of these conveyor mechanisms are capable of gripping the opposite sides of lumber to be cut and positively driving the lumber to and past the saw blade.

U.S. Pat. No. 4,452,118 discloses a conveyor mechanism for a shake resaw machine which grips and drives opposite sides of wooden blanks both ahead of and behind a saw blade. However, the construction of the conveyor mechanism is rather complex and it is not adapted for adjustable positioning on a band saw table.

An object of the present invention is to provide a simple and efficient lumber conveyor assembly for positioning on a band saw table.

Another object of the present invention is to provide a lumber conveyor assembly which can be adjustably positioned on a band saw table and which is capable of positively gripping each piece of lumber to be cut at two spaced apart locations, i.e., a first location ahead of a second location behind the band saw blade, and which can accommodate pieces of lumber of varying widths.

SUMMARY OF THE INVENTION

According to the present invention the lumber conveyor assembly includes separate guide/drive subassemblies which are positionable on a band saw table on opposite sides of the saw blade thereof, each of the guide/drive subassemblies including a pair of spaced apart, positively driven gripping rollers which can grip a piece of lumber fed between the guide/drive subassemblies so as to move it through the assembly, the pair of gripping rollers on one of the guide/drive subassemblies being spring biased so as to accommodate pieces of lumber of varying thickness fed between the guide/drive subassemblies, and a transmission device which extends between the guide/drive subassemblies so as to assure that the pair of gripping rollers on one guide/drive subassembly will rotate at the same speed but in the opposite direction to the pair of gripping rollers of the other guide/drive subassembly, thus positively driving each piece of lumber fed between the guide/drive subassemblies in the proper direction.

A further understanding of the present invention will be achieved by reference to the accompanying drawings, taken in conjunction with the following discussion.

DETAILED DESCRIPTION OF THE PREFERRED EMBODIMENT

Figure 1:
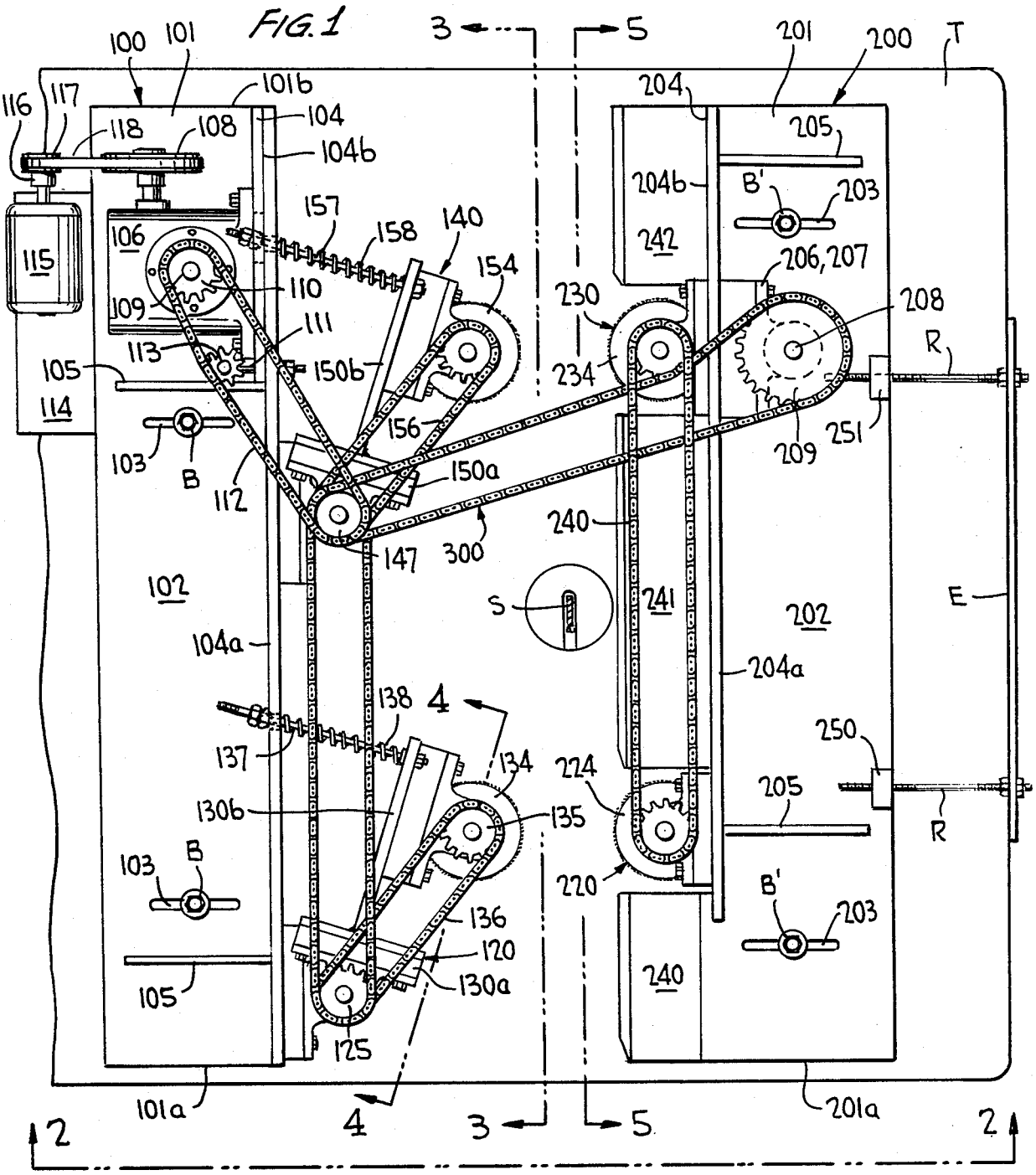
FIG. 1 is a top plan view of a preferred construction of a lumber conveyor assembly according to the present invention, the lumber conveyor being shown mounted on a band saw table such that its first and second guide/drive subassemblies are operatively positioned on opposite sides of a band saw blade and the transmission chain connecting the two guide/drive subassemblies is shown behind the band saw blade in the direction of lumber movement therepast.
Figure 2:
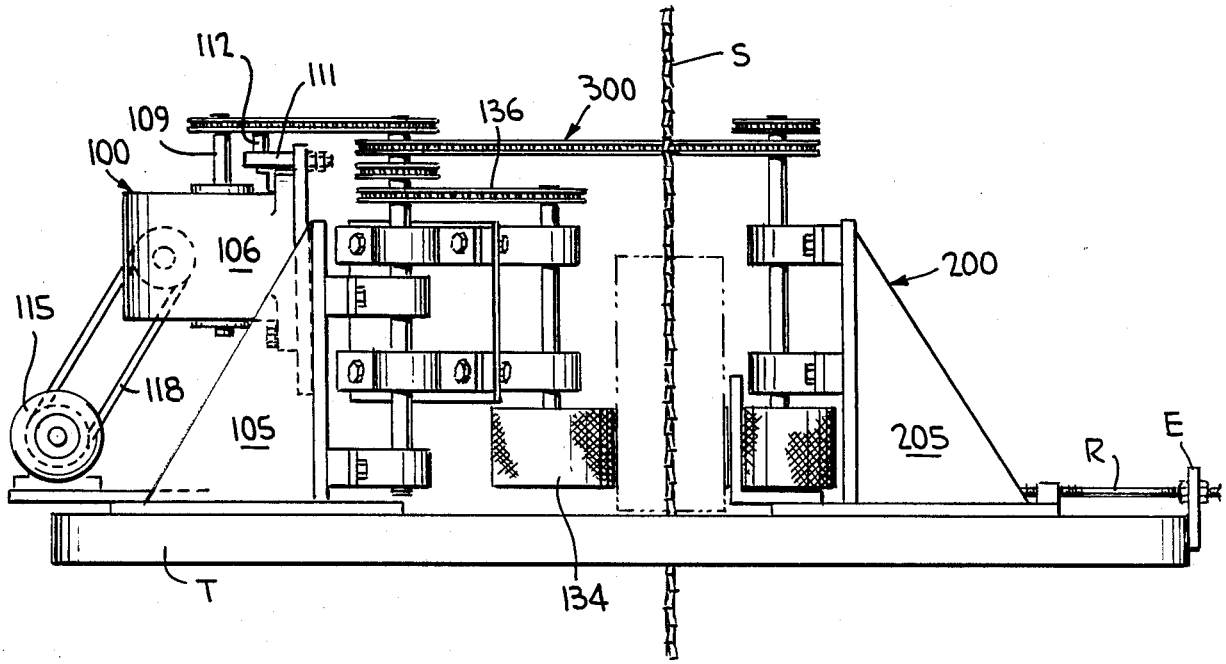
FIG. 2 shows an elevational front (inlet) end view of the lumber conveyor assembly as seen along line 2—2 in FIG. 1.
Figure 4:
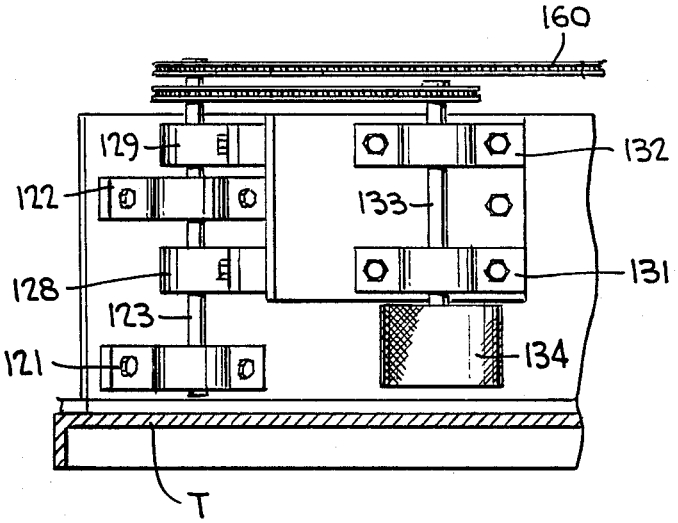
FIG. 4 shows an elevational side view of the front drive mechanism of the first guide/drive subassembly as seen generally along line 4—4 in FIG. 1.

A preferred embodiment of a lumber conveyor assembly according to the present invention, when mounted on a horizontal table T of a band saw, is shown in FIGS. 1–5. The lumber conveyor assembly is seen to include a first guide/drive subassembly 100, which is shown in FIG. 1 to be positioned on table T on the left side of the band saw blade S in the direction of lumber travel, a second guide/drive subassembly 200, which is shown in FIG. 1 to be positioned on table T on the right side of the band saw blade S in the direction of lumber travel, and a transmission chain 300 which extends between these subassemblies. The features and functioning of these parts of the lumber conveyor assembly will now be discussed in detail.

Referring to FIGS. 1–4, the first guide/drive subassembly 100 includes a metal mounting element 101 which has a front end **101*a* and a rear end 101*b* and is formed by a horizontal foot plate 102, a vertical support plate 104 and two spaced apart brace plates 105. The vertical support plate 104 is welded to the top of the foot plate 102 and the brace plates 105 are welded to the top of the foot plate 102 and to a rear side 104*a* of the support plate 104 so as to provide a rigid structure. The foot plate 102 includes two spaced apart slots 103 which are oriented perpendicularly to the support plate 104. By way of bolts B which extend downwardly through the slots 103 and into the band saw table T, the mounting element 101** can be adjustably positioned and oriented on the band saw table relative to the band saw blade S.

Attached to the rear side **104*a* of the vertical support plate 104 near the rear end of the mounting element is a gear box 106. The gear box 106 includes a horizontal input shaft 107 having a grooved wheel 108 attached thereto, as well as a vertical output shaft 109 having a sprocket 110 keyed thereon. Also attached to the rear side of the vertical support plate 104 at a point near the gear box 106 is a bracket 111, which supports a vertical shaft 112 having an idler sprocket 113 keyed thereon. The idler sprocket 113 is positioned at the same height above the foot plate 102 as the sprocket 108. A driven chain 112 is engaged with the sprocket 110 and the idler sprocket 113 (it is also engaged with a sprocket 147, as will be discussed below). A motor mount plate 114 is attached to foot plate 102 near the rear end of the mounting element 101, and an electric motor 115 is mounted on the motor mount plate 114. The motor 115 includes a horizontal output shaft 116 and a grooved wheel 117 attached thereto. A drive belt 118 is connected between the grooved wheel 117 on the output shaft 116 of the motor 115 ann the grooved wheel 108 on the input shaft 107 of the gear box 106**.

Attached to a front side 104*b* of the support plate 104 near the front end of the mounting element is a front driver mechanism 120. This front driver mechanism includes two vertically separated pillow blocks 121, 122 which are bolted to the support plate 104 and a vertical pivot shaft 123 having two vertically separated sprockets 124, 125 keyed to its upper end. The front driver mechanism also includes a generally T-shaped platform 130 which includes a base portion 130*a* and a projecting portion 130*b*. The base portion 130*a* mounts two vertically separated pillow blocks 128, 129 which are pivotally mounted on the pivot shaft 123. The projecting portion 130*b* mounts two vertically separated pillow blocks 131, 132, which in turn support a vertival drive shaft 133. A gripping roller 134 is fixedly attached to the lower end of the vertical drive shaft 133 and a sprocket 135 is keyed to the upper end thereof. The sprocket 135 is located at the same vertical height above the foot plate 102 as the lower sprocket 124 on the pivot shaft 123. A drive chain 136 extends between and around the lower sprocket 124 on the pivot shaft 123 and the sprocket 135 on the drive shaft 133 so that rotation of the pivot shaft 123 will cause simultaneous rotation of the drive shaft 133 and thus gripping roller 134. As seen in FIG. 1, an adjustment screw 137 extends from the projecting portion 130*b* of the platform 130 to the support plate 104 at a location rearwardly of the pillow blocks 121, 122. In addition, a helical spring 138 is positioned around the adjustment screw 137 and between the projecting portion 130*b* of the platform 130 and the support plate 104 so as to bias the platform 130 (and thus the gripping roller 134) away from the support plate and towards the second guide/drive subassembly 200.

A rear driver mechanism 140 is attached to the support plate 104 between the front driver mechanism and the rear end of the mounting element, this rear driver mechanism including two vertically separated pillow blocks 141, 142 which are bolted to the support plate 104, and a vertical pivot shaft 143 which extends through the pillow blocks 141, 142. Four vertically separated sprockets 144, 145, 146, 147 are keyed to the upper end of the pivot shaft 143. The rear driver mechanism also includes a generally T-shaped platform 150 includes a base portion 150*a* and a projecting portion 150*b*. The base portion 150*a* mounts two vertically separated pillow blocks 148, 149 which are pivotally mounted on the pivot shaft 14. The projecting portion 150*b* mounts two vertically separated pillow blocks 151, 152, which in turn support a vertical drive shaft 153. A gripping roller 154 is fixedly attached to the lower end of the vertical shaft 153 and a sprocket 155 is keyed to the upper end thereof. The sprocket 155 is located at the same vertical height above the foot plate 102 as the lowest sprocket 144 on the pivot shaft 143. A drive chain 156 extends between the lowest sprocket 144 on the pivot shaft 143 and the sprocket 155 on the drive shaft 153 so that rotation of the pivot shaft 143 will cause somultaneous rotation of the drive shaft 153 and thus gripping roller 154. As seen in FIG. 1, an adjustment screw 157 extends from the projecting portion 150*b* of the platform 150 and the support plate 104 at a location rearwardly of the pillow blocks 141, 142. In addition, a helical spring 158 is positioned around the adjustment screw 157 and between the projecting portion 150*b* of the platform 150 and the support plate 104 so as to bias the platform 150 (and thus the gripping roller 154) away from the support plate and towards the second guide/drive subassembly 200.

The second lowest sprocket 145 on the pivot shaft 143 and the upper sprocket 125 on the pivot shaft 123 are located at the same height above the foot plate 102, and a drive chain 160 extends between and around these sprockets so that rotation of the pivot shaft 143 will cause simultaneous rotation of the pivot shaft 123. In addition, the uppermost sprocket 147 on the pivot shaft 143 is located at the same height above the foot plate 102 as the sprocket 110 on the output shaft 109 and the idler sprocket 115, and the main drive chain 112 (referred to above) engages all three of these sprockets so that rotation of the output shaft 109 of the gear box 106 will cause simultaneous rotation of the pivot shaft 143.

Figure 5:
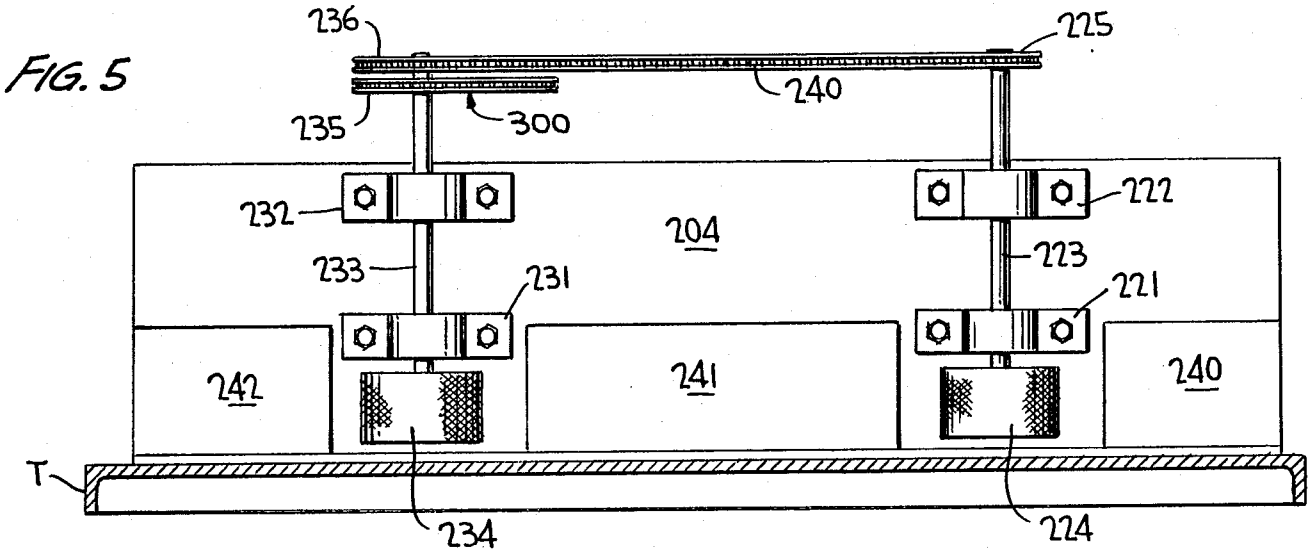
FIG. 5 shows an elevational side view of the second guide/drive subassembly as seen along line 5—5 in FIG. 1.

Turning now to the second guide/drive subassembly 200, as seen in FIGS. 1 and 5, it comprises a metal mounting element 201 which has a front end 201*a* and a rear end 201*b* and is formed by a horizontal foot plate 202, a vertical support plate 204 and two spaced apart brace plates 205. The vertical support plate 204 is welded to the top of the foot plate 202 and the brace plates 205 are welded to the top of the foot plate 202 and a rear side 204*a* of the support plate 204 so as to provide a rigid structure. The foot plate 202 includes two spaced apart slots 203 which are oriented perpendicularly to the support plate 204. By way of bolts B' which extend downwardly through the slots 203 into the band saw table T, the mounting element 201 can be adjustably positioned and oriented on the band saw table relative to the band saw blade S.

Attached to the rear side 204*a* of the vertical support plate 204 are two vertically disposed pillow blocks 206, 207 which mount a vertical shaft 208 having an idler sprocket 209 keyed to its upper end. This idler sprocket is located at the same height above the foot plate 202 as the second uppermost sprocket 146 on the pivot shaft 143 of the rear driver mechanism 140 of the first guide/-drive subassembly 100.

Attached to a front side 204*b* of the vertical support plate 204 are front and rear driver mechanisms 220 and 230, these driver mechanisms being separated by about the same distance that the gripping rollers 134 and 154 of the front and rear driver mechanisms 120 and 140 of the first guide/drive subassembly are separated. The front driver mechanism includes two vertically spaced pillow blocks 221, 222 and a vertical drive shaft 223 which extends upwardly therethrough, the drive shaft 223 having a gripping roller 224 fixedly mounted to its lower end and a sprocket 225 keyed to its upper end. The rear driver mechanism includes two vertically spaced pillow blocks 231, 232 and a vertical drive shaft 233 which extends upwardly therethrough, the drive shaft 233 having a gripping roller 234 fixedly mounted to its lower end and two vertically separated sprockets 235, 236 keyed to its upper end. The upper sprocket 236 is located at the same height as the sprocket 225 on the drive shaft 223 of the front driver mechanism 220, whereas the lower sprocket 235 is located at the same height as the idler sprocket 209. A drive chain 240 extends between and around the upper sprocket 236 on the drive shaft 233 and the sprocket 225 on the drive shaft 223 so that rotation of the drive shaft 233 will cause simultaneous rotation of the drive shaft 223.

Figure 3:
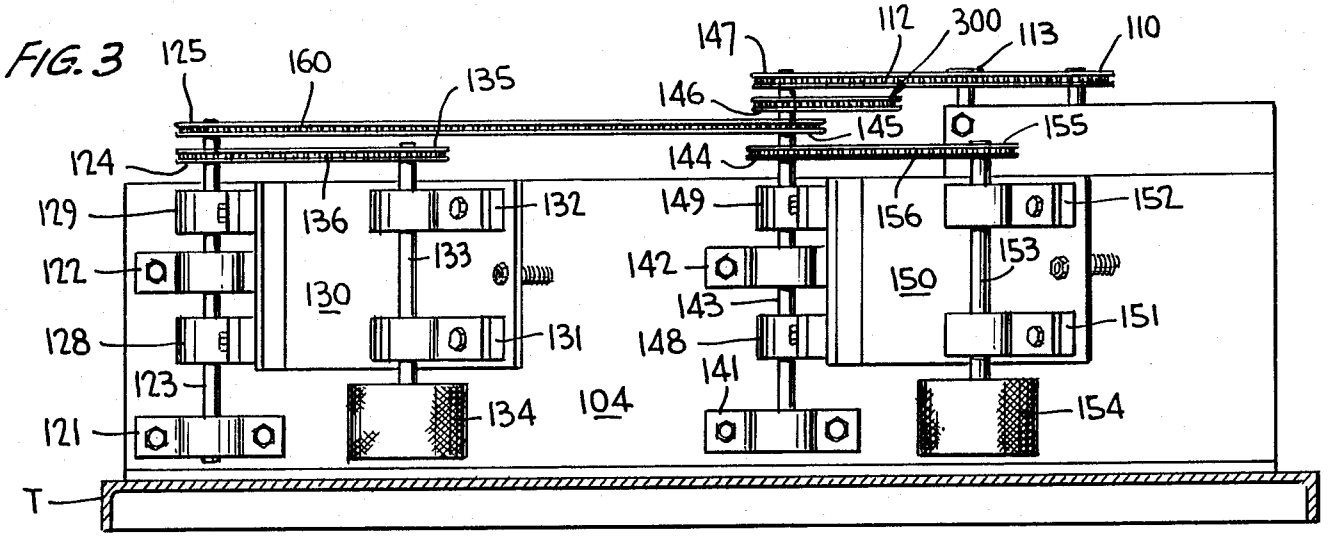
FIG. 3 shows an elevational side view of the first guide/drive subassembly as seen along line 3—3 in FIG. 1.

As seen in FIGS. 1 and 3, the transmission chain 300 extends around and between the second highest sprocket 146 on the pivot shaft 143 of the rear driver mechanism of the first guide/drive subassembly 100 and the idler sprocket 209 on the shaft 208 of the second guide/driver subassembly, while also engaging the lower sprocket 235 on the drive shaft 233 of the rear driver mechanism 230, such that rotation of the pivot shaft 143 will cause simultaneous rotation of the drive shaft 233. It should be noted that the transmission chain is engaged with the lower sprocket 235 such that the direction of rotation of the drive shaft 233 will be opposite to that of the pivot shaft 143.

Also mounted on the foot plate 202 are front, middle, and rear L-shaped guide flanges 240, 241, 242, the front guide flange 240 being located in front of the front driver mechanism 220, the middle guide flange 241 being located between the front driver mechanism 220 and the rear driver mechanism 230, and the rear guide flange 242 being located to the rear of the rear driver mechanism 230. The guide flanges 240–242 provide guide surfaces along which the lumber is moved. The guide flanges are so mounted on the foot plate 202 that the peripheries of the gripping rollers 224 and 234 will extend away from the support plate 204 slightly further than the guide flanges 240, 241 and 242. A preferred distance is 1/32 of an inch.

Also mounted on the foot plate 202 are metal flanges 250, 251 which receive adjustment rods R which can be used to adjust the positioning of the second guide/drive subassembly relative to an edge skirt E of the band saw table (and thus also relative to the band saw blade S).

In use, the first and second guide/drive subassemblies 100 and 200 of the inventive lumber conveyor assembly are located on the band saw table T on opposite sides of the band saw blade S, and by the adjustement of bolts B,B' and adjustment rods R they are properly positioned so that the distance and orientation of the guide flanges 240–242 of the guide/driver subassembly 200 relative to the band saw blade S is correct and so that the spacing between the gripping rollers 134, 154 of the first guide/drive subassembly 100 and the gripping rollers 224 and 234 of the second guide/drive subassembly 200 is less than the thickness of the lumber to be conveyed therebetween. The electric motor 115 is turned on such that, via the drive belt 118, the drive chains 112, 136, 156, transmission chain 300, and drive chain 240, the gripping rollers 134, 154, 224 and 234 will be rotated in unision, the gripping rollers 134, 154 having an opposite rotation to the gripping rollers 224, 234.

When a strip of lumber is fed to the front (inlet) end of the lumber conveyor, its leading end will come in contact with the opposed gripping rollers 134, 224, and it will be positively driven by them to and through the band saw blade S, and subsequently the opposed gripping rollers 154, 234 will grip the two strips of cut lumber and drive them out of the conveyor assembly. The pivotal rotation of the platforms 130, 150 of the front and rear driver mechanisms 120 and 140 of the first guide/drive subassembly 100 will allow strips of lumber of varying thickness to be positively gripped by all the gripping rollers and thus effectively passed through the conveyor assembly.

Although a preferred embodiment of the present invention has now been described in detail, it is obvious that modifications can be made thereto and still fall within the scope of the appended claims.

I claim:

1. A lumber conveyor assembly which can be mounted on a band saw table and operated to positively grip pieces of lumber supplied thereto and move them to and through a band saw blade, said lumber conveyor assembly comprising a first guide/drive subassembly which is mountable on the band saw table on one side of the band saw blade, said first guide assembly including a first mounting element having a front and a rear end, said first mounting element including a first support plate which has a front side intended to face pieces of lumber moving through the lumber conveyor assembly and an opposite rear side, a first driver mechanism attached to the front side of said first support plate near the front end of said first mounting element, said first driver mechanism including a first platform which is movable toward and away from said first support plate, a first spring means for biasing said first platform away from said first support plate, a first drive shaft mounted on said first platform, and a first gripping roller attached to said first drive shaft, a second driver mechanism attached to the front side of said support plate between the first driver mechanism and the rear end of said first mounting element, said second driver mechanism including a second platform which is movable toward and away from said first support plate, a second spring means for biasing said second platform away from said first support plate, a second drive shaft mounted on said second platform, and a second gripping roller attached to said second drive shaft, and a first drive system for simultaneously rotating said first and second drive shafts such that the first and second gripper rollers respectively mounted thereon will rotate in the same direction and at the same speed, a second guide/drive subassembly which is mountable on the band saw table on an opposite side of the band saw blade from said first guide/drive subassembly, said second guide/drive subassembly including a second mounting element having a front end and a rear end, said second mounting element including a second support plate which has a front side intended to face pieces of lumber moving through the lumber conveyor assembly and an opposite rear side, a third driver mechanism attached to the front side of said second support plate near the front end of said second mounting element, said third driver mechanism including a third drive shaft having a third gripper roller attached thereto, a fourth driver mechanism attached to the front side of said second support plate between the third driver mechanism and the rear end thereof, said fourth driver mechanism including a fourth drive shaft having a fourth gripper roller attached thereto, said fourth driver mechanism driver mechanism being spaced from said third driver mechanism about the same distance said second driver mechanism is spaced from said first driver mechanism, a second drive system for simultaneously rotating said third and fourth drive shafts such that the third and fourth gripper rollers respectively mounted thereon will rotate in the same direction and at the same speed, and transmission means connected between said first and second guide/drive subassemblies so that said third and fourth drive shafts of the third and fourth driver mechanisms of said second guide/drive subassembly will rotate at the same speed but in the opposite direction to the first and second drive shafts of the first and second driver mechanisms of said first guide/drive subassembly.

2. A lumber conveyor assembly according to claim 1, wherein said first drive shaft includes a first sprocket keyed thereon, wherein said second drive shaft includes a second sprocket keyed thereon, wherein said first drive system includes separate first and second drive chains respectively engaging said first and second sprockets, wherein said third drive shaft includes a third sprocket keyed thereon, wherein said fourth drive shaft includes a fourth sprocket keyed thereon, and wherein said second drive system includes a third drive chain connected between and round said third and fourth sprockets.

3. A lumber conveyor assembly according to claim 2, wherein said first platform includes a first base portion and a first extension portion; wherein said first base portion is pivotally connected to said first support plate; wherein said first extension portion mounts said first drive shaft; and wherein said first spring means comprises a first adjustment screw which extends from said first extension portion to said first support plate and a first helical spring positioned around said first adjustment screw and between said first support plate and said first extension portion.

4. A lumber conveyor assembly according to claim 3, wherein said second platform includes a second base portion and a second extension portion; wherein said second base portion is pivotally connected to said first support plate; wherein said second extension portion mounts said second drive shaft; and wherein second spring means comprises a second adjustment screw which extends from said second extension portion to said first support plate and a second helical spring positioned around said second adjustment screw and between said first support plate and said second extension portion.

5. A lumber conveyor assembly according to claim 4, wherein said first driver mechanism includes a first pivot shaft rotatably mounted on said first support plate and to which the first base portion of said first platform is pivotally attached, wherein fifth and sixth sprockets are keyed to first pivot shaft, wherein said first drive chain is attached to said fifth sprocket, wherein said second driver mechanism includes a second pivot shaft rotatably mounted on said first support plate and to which the second base portion of said second platform is pivotally attached, wherein seventh, eighth, ninth and tenth sprockets are keyed to said second pivot shaft, wherein said second drive chain is connected to said seventh sprocket, and wherein said first drive system includes a fourth drive chain which is connected between said sixth sprocket and said eighth sprocket.

6. A lumber conveyor assembly according to claim 5, wherein said first drive system includes a motor mounted on said first mounting element, a gear box mounted on said first mounting element, a drive belt connecting said motor with said gear box and a fifth drive chain connecting said gear box with said tenth sprocket.

7. A lumber conveyor assembly according to claim 6, including eleventh and twelfth sprockets keyed to said third drive shaft, a thirteenth sprocket keyed to said fourth shaft, and wherein said second drive system includes a sixth drive chain connecting said eleventh and thirteenth sprockets.

8. A lumber conveyor assembly according to claim 7, including an idler sprocket mounted on said second mounting element, and wherein said transmission means comprises a transmission chain which extends from said ninth sprocket to said idler sprocket and engages said twelfth sprocket so as to rotate said third drive shaft in an opposite direction from said second pivot shaft.

9. A lumber conveyor assembly according to claim 1, wherein said first and second mounting elements respectively include first and second foot plates, each of which include slots through which bolts can pass to adjust the positioning of said foot plates on a band saw table.

* * * * *